US005784725A

United States Patent [19]

Joiner

[11] Patent Number: 5,784,725

[45] Date of Patent: Jul. 28, 1998

[54] DRAIN CLOSURE

[76] Inventor: Evelyn S. Joiner, 3880 S. Hillcrest Dr., Denver, Colo. 80237

[21] Appl. No.: 887,651

[22] Filed: Jul. 3, 1997

[51] Int. Cl.[6] ..... A47K 1/14

[52] U.S. Cl. ..... 4/295; 4/287

[58] Field of Search ..... 4/286, 287, 293, 4/294, 295

[56] References Cited

U.S. PATENT DOCUMENTS

| | | | |
|---|---|---|---|
| 1,014,389 | 1/1912 | Haff | 4/295 |
| 1,659,839 | 2/1928 | Smith | 4/295 |
| 1,704,023 | 3/1929 | Stead . | |
| 1,741,242 | 12/1929 | Lemm | 4/287 |
| 1,912,312 | 5/1933 | Schatch | 4/295 |
| 2,487,635 | 11/1949 | Carpenter | 4/295 |
| 2,544,498 | 3/1951 | Hiertz . | |
| 2,572,101 | 10/1951 | Bloch . | |
| 3,005,996 | 10/1961 | Hyde . | |
| 4,706,306 | 11/1987 | Smith . | |

*Primary Examiner*—Charles E. Phillips
*Attorney, Agent, or Firm*—Ancel W. Lewis, Jr.

[57] ABSTRACT

A removable drain closure disclosed has a rigid closure body, a flexible sealing member on one face of the support body and flexible legs connected to the sealing member that support the body for flow past the closure in a first position and move inside a drain to a sealed second position. If the closure is inverted the legs also support the support body to allow for drainage through the drain outlet.

9 Claims, 2 Drawing Sheets

DRAIN CLOSURE

TECHNICAL FIELD

This invention relates to stoppers or closures for drains that are particularly suitable for use with a sink drain passing water and waste into a disposal unit.

BACKGROUND ART

A variety of drain closures have heretofore been provided. Garbage disposal units typically have a drain outlet through which water flows from the sink through the drain outlet and through the garbage disposal unit. A variety of attempts have been made to provide closures to selectively leave the drain open for drainage and then prevent the water from draining into the disposal unit.

Stead U.S. Pat. No. 1,704,023 and Bloch U.S. Pat. No. 2,572,101 disclose closures for drains with flexible legs that insert into the drain outlet and hold the closure in sealed engagement to block flow with Bloch having flexible legs that allow the stopper to be held in a raised position to allow the water to flow past the closure.

Hiertz U.S. Pat. No. 2,544,498 shows a strainer-stopper assembly for use in a sink drain using legs to position the assembly in the drain that extend down below the stopper sealing surface.

Hyde U.S. Pat. No. 3,005,996 shows a sink stopper for use in conjunction with a drain outlet to a waste disposer but lacks a drain sleeve permanently attached to the drain outlet.

Smith U.S. Pat. No. 4,706,306 shows a stopper with a guide stem that fits into a guidance aperture of a drain housing but drains to disposal units do not generally have such guidance apertures.

DISCLOSURE OF THE INVENTION

The invention disclosed is a removable drain closure having a disk shaped rigid imperforate closure body with oppositely facing first and second surfaces. An annular flexible sealing member is provided on the first surface. A grip is provided on the second surface for being gripped by a user. A plurality of circumferentially spaced legs extend out from the periphery of the sealing member. The legs have a first end located to position the body above and spanning the drain outlet allowing flow past the body to a second sealing position in which the legs are deflected back up from the sealing member. The downward force of water against the body moves the sealing member in an axial direction against an inner radial surface of a drain outlet to enhance the sealing function. The legs have a second end that position the body above and in spaced relation to the drain outlet to allow water flow past the body if the body is inverted.

BRIEF DESCRIPTION OF THE DRAWINGS

Details of this invention are described in connection with the accompanying drawings which like parts bear similar reference numerals in which.

DETAILED DESCRIPTION

Figure 1:
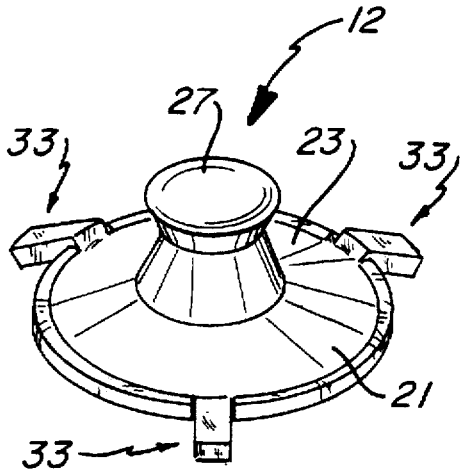
FIG. 1 is a top perspective view of a drain closure embodying features of the present invention.
Figure 2:
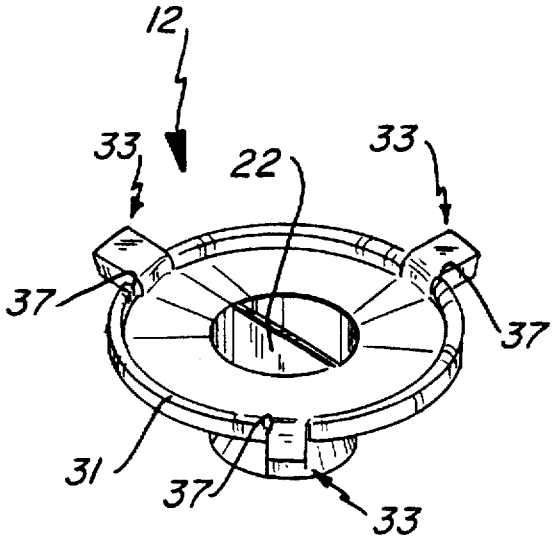
FIG. 2 is a bottom perspective view thereof.

Referring now to FIGS. 1–7 there is shown a drain closure 12 embodying features of the present invention. The drain closure 12 shown in FIG. 3 in its normal position over a drain outlet 13 typically found in a sink 14 above a garbage disposal unit 15. The drain outlet 13 typically includes an outer radial surface 17, an intermediate axial surface 18 and an inner radial surface 19. The closure 12 shown includes a disk shaped imperforate closure body 21 having a first surface 22 and a second surface 23 opposite the first surface. The body 21 shown is of an inverted conical shape but it is understood that it may take other shapes such as being flat or concave-convex or the like. Body 21 shown preferably is a rigid, hard PVC plastic through which water will not flow. The first surface 22 is a bottom surface and the second surface is a top surface for the normal operating position for the closure. A reinforcing rib 25 is provided at a central position on the bottom on the first surface which also serves as a grip means for gripping by the user if the body becomes inverted.

A projection 27 on the second surface at the center of the body is in the form of a hollow knob which has an undercut and is a grip means for grasping by the user to pick up and locate the closure over the drain outlet 13.

A sealing member 31 is connected to the first surface 22 adjacent the peripheral edge of the closure body 21. The sealing member 31 is flexible, continuous, annular and in the form of a semicircular ring or bead and shaped to generally conform to the shape of the inner annular radial surface 19 of the drain outlet to rest thereon.

A plurality of circumferentially spaced spacers or legs 33 connect to the sealing member and are preferably integral with and formed of the same material as the sealing member. This material is preferably a soft rubber material and is flexible. Each leg 33 has a first end 34 disposed axially beyond the plane of the first surface 22 to engage the top of the drain outlet when the body is disposed in the normal upright first position in the sink and allows the water to pass through the drain outlet as shown in FIG. 4.

Figure 7:
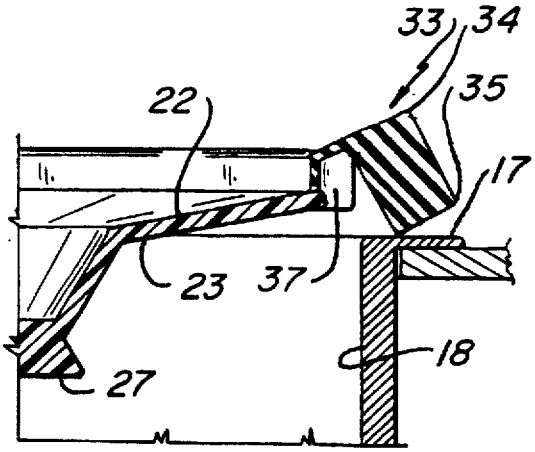
FIG. 7 is like FIG. 4 with the closure in an inverted position allowing water to pass through the drain outlet.

Each leg 33 has a second end 35 disposed axially beyond the plane of the second surface to support the body above the drain when the body is in an inverted position as shown in FIG. 7 allowing the water to pass through the drain outlet. A recess slot 37 is shown included in the sealing member adjacent each leg to permit the leg to pass through the drain outlet to the sealed position.

Figure 3:
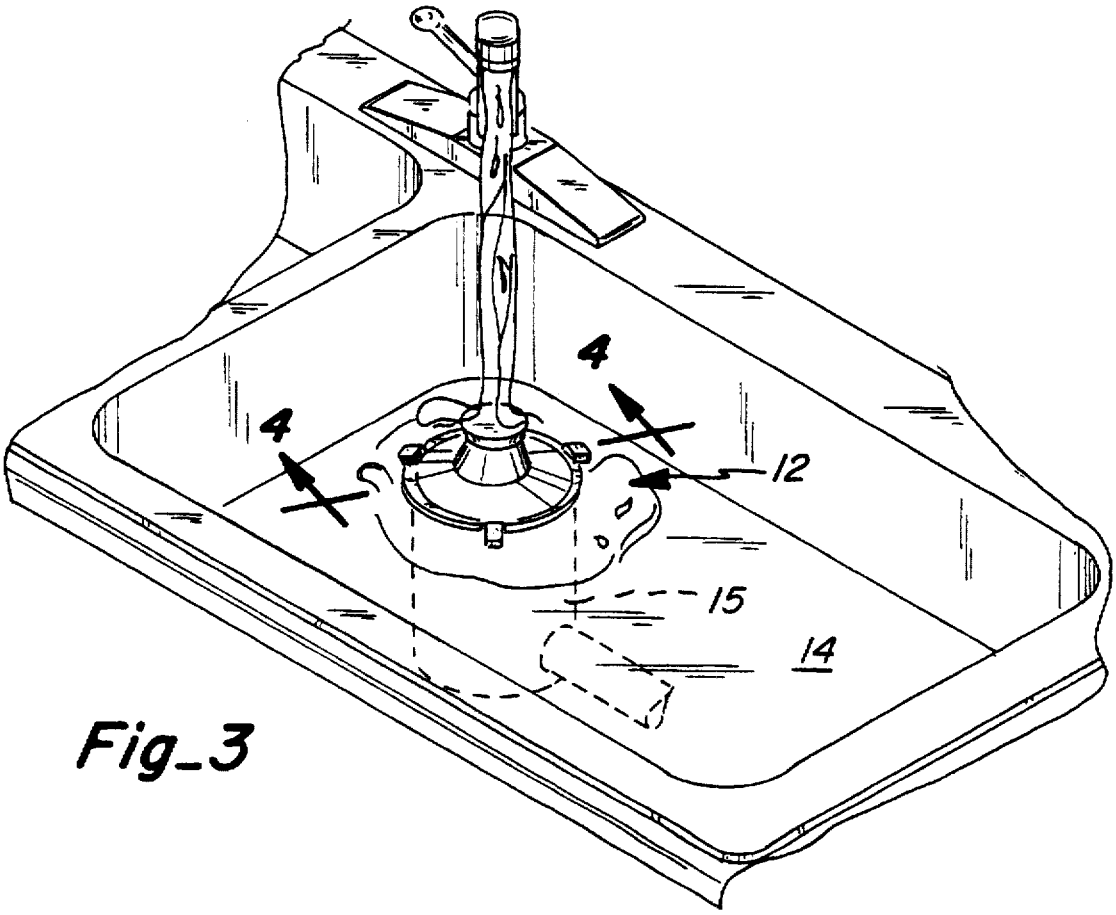
FIG. 3 is a top perspective view of the closure device shown in FIGS. 1 and 2 in a sink above a garbage disposal unit.
Figure 4:
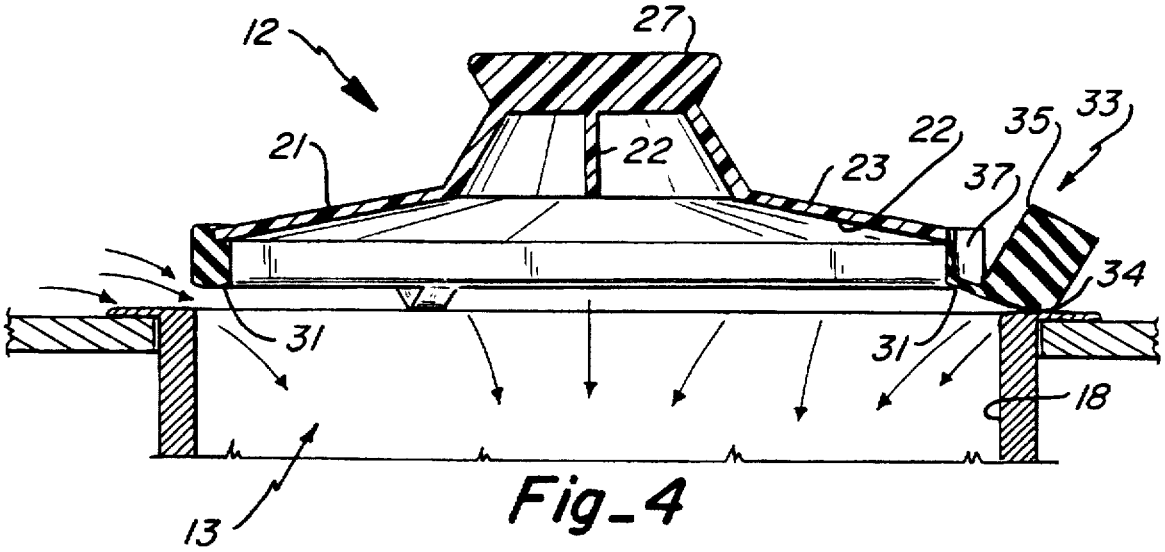
FIG. 4 is a sectional view taken along line 4—4 of FIG. 3 showing the closure body in the normal or first position allowing water to drain through the drain outlet.
Figure 5:
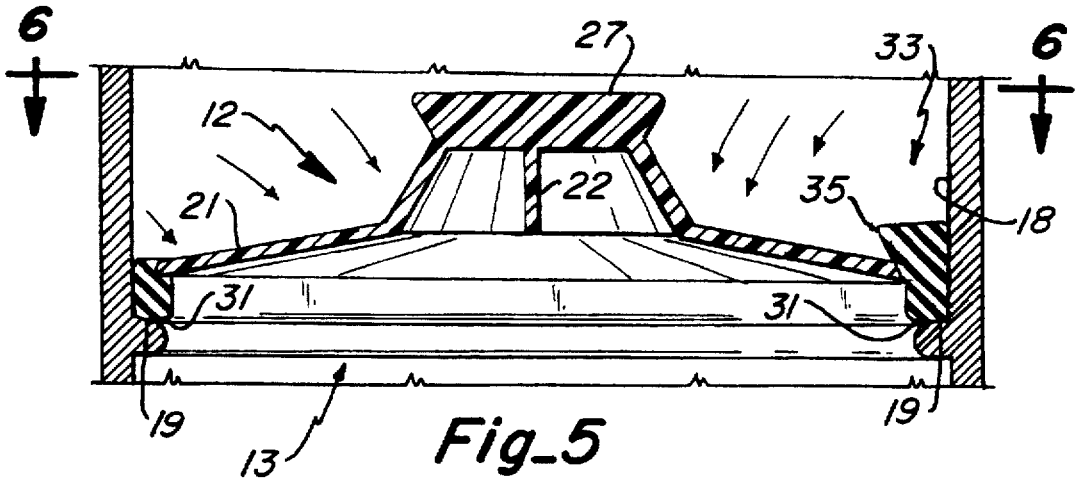
FIG. 5 is the same view as FIG. 4 with the closure in the sealed position preventing water flow through the drain outlet.
Figure 6:
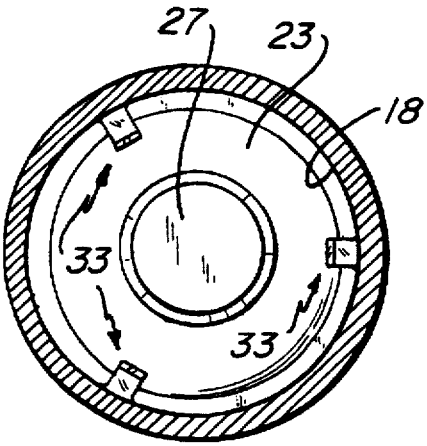
FIG. 6 is a sectional view taken along line 6—6 of FIG. 5.

In use the leg supports the closure body 21 in an upright raised first position as shown in FIGS. 3 and 4. In a sealed second position the closure body 21 is inserted down into the drain outlet and the axial side walls surface 18 deflect the legs back from the sealing member and the sealing member bears against the inner radial surface 19 so that flow through is prevented the drain outlet. In the event the device becomes accidentally inverted shown in FIG. 7 the legs 33 will support the body in a raised position so that water will flow through the drain outlet.

The closure of the present invention is able to accommodate a wide variation in sink drain opening dimensions.

Because the closure can be used with many brands and models of sinks and disposal units and because of the economical construction, the advantage to the market for replacement closures is significant.

Although the present invention has been described with a certain degree of particularity, it is understood that the present disclosure has been made by way of example and that changes in details of structure may be made without departing from the spirit thereof.

What is claimed is:

1. A drain closure, comprising:

a closure body having oppositely facing first and second surfaces, a flexible annular sealing member connected to said first surface adjacent a peripheral edge of said body, said sealing member being sized and shaped to contact and form a seal with an inner radial surface of a drain outlet, a plurality of circumferentially spaced, flexible legs connected to said sealing member, each leg having an end disposed axially beyond a plane of said first surface to support said first surface above said drain outlet when said body is upright in a first position allowing water to pass through said drain outlet, said legs being deflected back from said sealing member as said closure body, sealing member and legs are inserted down into said drain outlet, said sealing member forming a seal against said inner radial surface in a second position preventing fluid flow through said drain outlet.

2. A closure as set forth in claim 1 wherein said closure body is imperforate and disk shaped and is made of a rigid, hard, plastic material.

3. A closure as set forth in claim 1 wherein said sealing member and said legs are formed as a single unitary piece of a flexible soft rubber material.

4. A closure as set forth in claim 1 wherein said body is sized to fit a drain outlet that is an inlet to a garbage disposal unit.

5. A closure as set forth in claim 1 including a grip means on said second surface for being grasped by a user.

6. A closure as set forth in claim 1 wherein there are three legs at 120 degree intervals around the circumference of said body.

7. A closure as set forth in claim 1 including a slot in said sealing member adjacent with each of said legs to permit said legs to pass through said drain outlet.

8. A closure as set forth in claim 1 wherein said sealing member is a continuous annular, generally semicircular ring.

9. A removable drain closure, comprising:

a disk shaped, rigid, imperforate closure body having a first surface and a second surface opposite said first surface, a grip means on said second surface for being grasped by a user, a flexible annular bead shaped sealing member connected to said first surface adjacent a peripheral edge of said body, said sealing member being sized and shaped to contact and form a seal with an inner radial surface of a drain outlet, a plurality of circumferentially spaced, flexible, legs connected to said sealing member, each leg having a first end disposed axially beyond a plane of said first surface to support said first surface above said drain outlet when said body is in an upright first position allowing water to pass through said drain outlet, said legs being deflected back from said sealing member as said body, sealing member and legs are inserted down into said drain outlet, said sealing member forming a seal against said inner radial surface to prevent flow through the drain outlet in a sealed second position, each leg having a second end disposed axially beyond a plane of said second surface to support said second surface above said drain outlet when said body is in an inverted position allowing water to pass through said drain outlet.

* * * * *